US011338168B2

(12) United States Patent
Yang

(10) Patent No.: US 11,338,168 B2
(45) Date of Patent: May 24, 2022

(54) FITNESS EXERCISE APPARATUS

(71) Applicant: YANGZHOU JIUYI HARDWARE & MACHINERY CO., LTD., Yangzhou (CN)

(72) Inventor: Yen-Shuo Yang, Taichung (TW)

(73) Assignee: YANGZHOU JIUYI HARDWARE & MACHINERY CO., LTD., Jiangsu (CN)

( * ) Notice: Subject to any disclaimer, the term of this patent is extended or adjusted under 35 U.S.C. 154(b) by 49 days.

(21) Appl. No.: 16/879,247

(22) Filed: May 20, 2020

(65) Prior Publication Data

US 2021/0361997 A1 Nov. 25, 2021

(51) Int. Cl.

*A63B 21/00* (2006.01)
*A63B 21/04* (2006.01)
*A63B 21/055* (2006.01)

(52) U.S. Cl.

CPC ..... *A63B 21/154* (2013.01); *A63B 21/0442* (2013.01); *A63B 21/0552* (2013.01); *A63B 21/4029* (2015.10); *A63B 21/4034* (2015.10); *A63B 21/4035* (2015.10); *A63B 2210/50* (2013.01)

(58) Field of Classification Search

CPC ..... A63B 21/154; A63B 21/4035; A63B 21/0552; A63B 21/4034; A63B 21/0442; A63B 21/4029; A63B 2210/50; A63B 22/0076–0089; A63B 21/00065; A63B 21/04; A63B 21/0428; A63B 21/151; A63B 21/4031; A63B 21/4043; A63B 21/4047; A63B 23/035; A63B 23/03525; A63B 23/03533; A63B 23/03566; A63B 2208/0204; A63B 2208/0233; A63B 2208/0238; A63B 23/03516; A63B 23/03541; A63B 23/0355; A63B 23/03558; A63B 23/03575; A63B 23/03583; A63B 23/03591

See application file for complete search history.

(56) References Cited

U.S. PATENT DOCUMENTS 6,585,626 B2 * 7/2003 McBride ..... A63B 21/04 482/130
6,685,601 B1 * 2/2004 Knapp ..... A63B 21/078 482/104

(Continued)

OTHER PUBLICATIONS

Search Report issued to European counterpart Application No. 20176240.8 by the EPO dated Nov. 3, 2020.

*Primary Examiner* — Joshua Lee
*Assistant Examiner* — Catrina A Letterman

(57) ABSTRACT

A fitness exercise apparatus includes a main frame, a seat frame, a plurality of elastic cords, a plurality of pulling units and a pair of handles. The main frame includes a support unit having bottom and top portions. The seat frame includes a guide rail, and a seat assembly slidably disposed on the guide rail and movable toward and away from the support unit. Each elastic cord extends from the bottom to the top portion of the support unit. Each pulling unit includes a plurality of pulley sets provided on the main frame and the seat frame, and a plurality of wires each of which is looped around a corresponding pulley set and connectable with a corresponding elastic cord. Each handle is connected to a selected one of the elastic cord and the wire.

5 Claims, 13 Drawing Sheets

(56) References Cited

U.S. PATENT DOCUMENTS

| | | | | |
|---|---|---|---|---|
| 6,981,932 | B1 | 1/2006 | Kuo | |
| 8,057,368 | B1 * | 11/2011 | Lyszczarz | A63B 3/00 482/103 |
| 10,010,740 | B2 * | 7/2018 | Hockridge | A63B 21/4047 |
| 2002/0077229 | A1 * | 6/2002 | McBride | A63B 23/03533 482/130 |
| 2007/0270293 | A1 * | 11/2007 | Zhuang | A63B 21/4029 482/123 |
| 2009/0149302 | A1 * | 6/2009 | Thuma | A63B 21/0628 482/99 |
| 2014/0243174 | A1 * | 8/2014 | Alenaddaf | A63B 17/00 482/142 |
| 2018/0229072 | A1 * | 8/2018 | Staten | A63B 21/078 |
| 2020/0269085 | A1 * | 8/2020 | Pfaff | A63B 21/154 |

* cited by examiner

FITNESS EXERCISE APPARATUS

FIELD

The disclosure relates to an exercise apparatus, more particularly to a fitness exercise apparatus that combines aerobic and strength training.

BACKGROUND

An existing rowing fitness machine, as disclosed in Taiwanese Patent No. M585159, includes a frame, a seat slidable along the frame, two foot pedals respectively disposed on left and right sides of the frame, a fan resistance mechanism disposed on a front end of the frame, a pulling device for driving a fan of the fan resistance mechanism to rotate, and a handgrip for driving the pulling device. The pulling device includes a chain, and an elastic cord connected to the chain.

After a user is seated on the seat with his/her feet positioned on the foot pedals, he/she can pull rearward the handgrip, so that the chain can drive a transmission sprocket of the fan resistance mechanism to rotate, and simultaneously, a connecting seat can pull forward the elastic cord so that the elastic cord can store a restoring force. When the user stops applying force, through the restoring force of the elastic cord, the user and the connecting seat are moved forward. Relatively, the chain and the handgrip connected to the connecting seat are also returned to their original forward positions.

Although the aforesaid rowing fitness machine can achieve its intended purpose, it can only provide a limited mode of exercise, so that the resulting muscle training cannot be comprehensive. Further, due to the mechanical inertia of the fan of the fan resistance mechanism, it is necessary to design other mechanisms to eliminate this inertia, making the mechanism complicated and prone to failure.

SUMMARY

Therefore, an object of the present disclosure is to provide a fitness exercise apparatus that combines aerobic and strength training to achieve training of the muscles of different parts of the body of a user.

According to this disclosure, a fitness exercise apparatus comprises a main frame, a seat frame, a plurality of elastic cords, a plurality of pulling units and a pair of handles. The main frame includes a base member, and a support unit disposed on the base member. The support unit has a bottom portion connected to the base member, and a top portion opposite to the bottom portion. The seat frame is connected to the main frame, and includes a guide rail, and a seat assembly slidably disposed on the guide rail. The seat assembly is movable toward and away from the support unit along the guide rail. The elastic cords are mounted on the main frame. Each elastic cord extends from the bottom portion to the top portion of the support unit. At least one of the elastic cords dampens the sliding movement of the seat assembly. Each pulling unit includes a plurality of pulley sets provided on the main frame and the seat frame, and a plurality of wires each of which is looped around a corresponding one of the pulley sets and connectable with a corresponding one of the elastic cords. Each handle is connected to a selected one of the elastic cord and the wire.

BRIEF DESCRIPTION OF THE DRAWINGS

Other features and advantages of the disclosure will become apparent in the following detailed description of the embodiment with reference to the accompanying drawings, in which.

DETAILED DESCRIPTION

Figure 1:
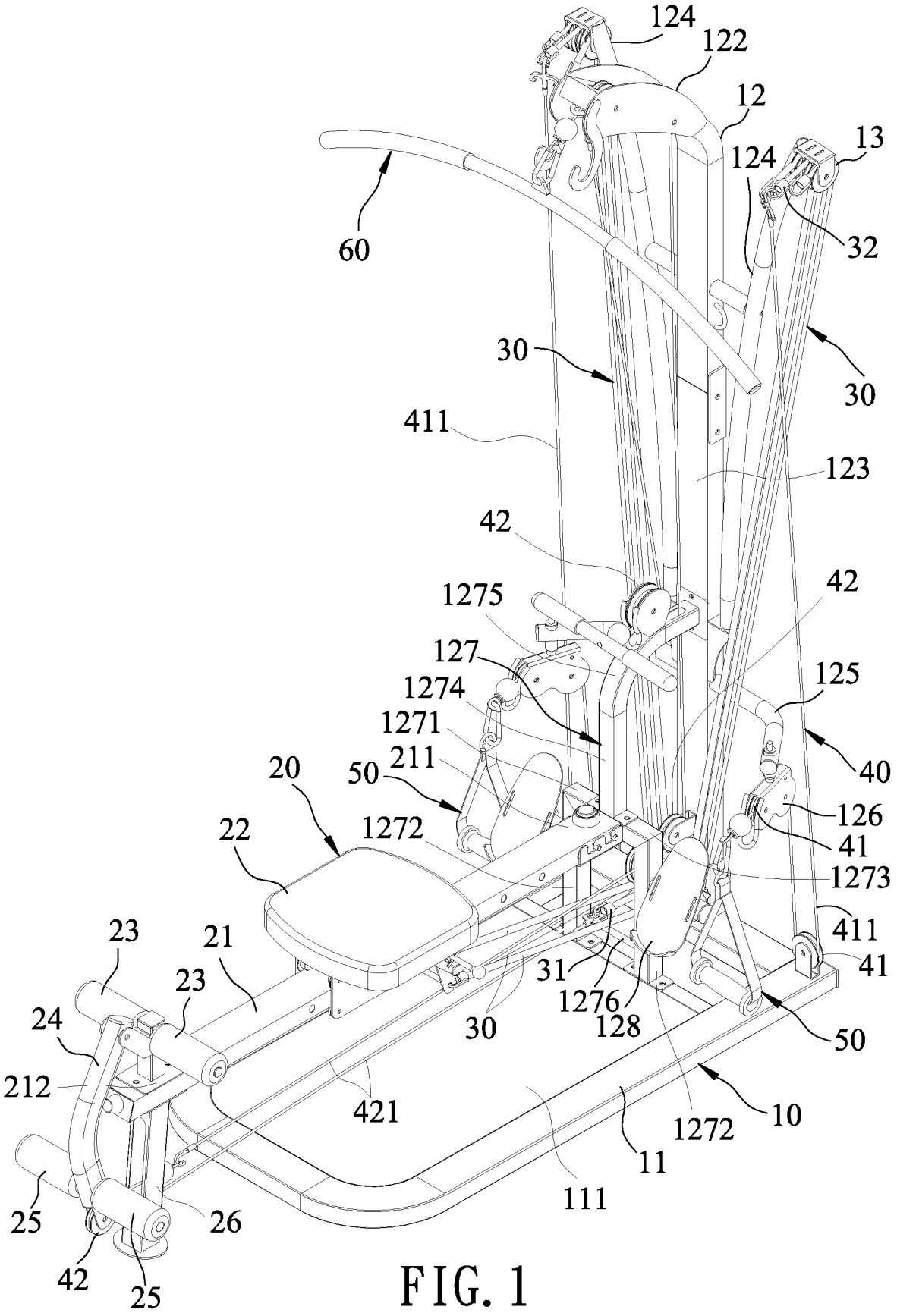
FIG. 1 is a perspective view of a fitness exercise apparatus according to an embodiment of the present disclosure.
Figure 2:
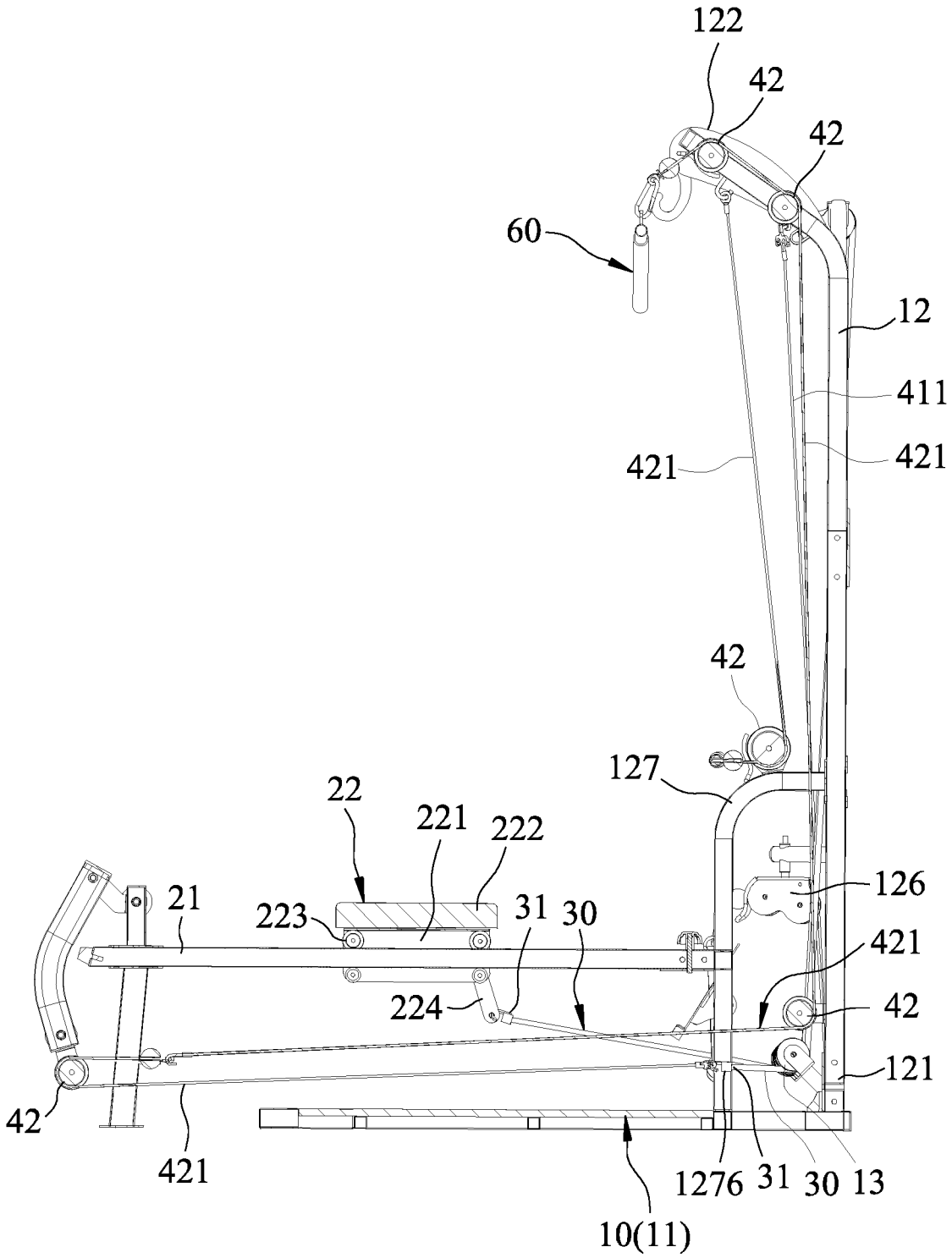
FIG. 2 is a partial sectional side view of the embodiment.
Figure 3:
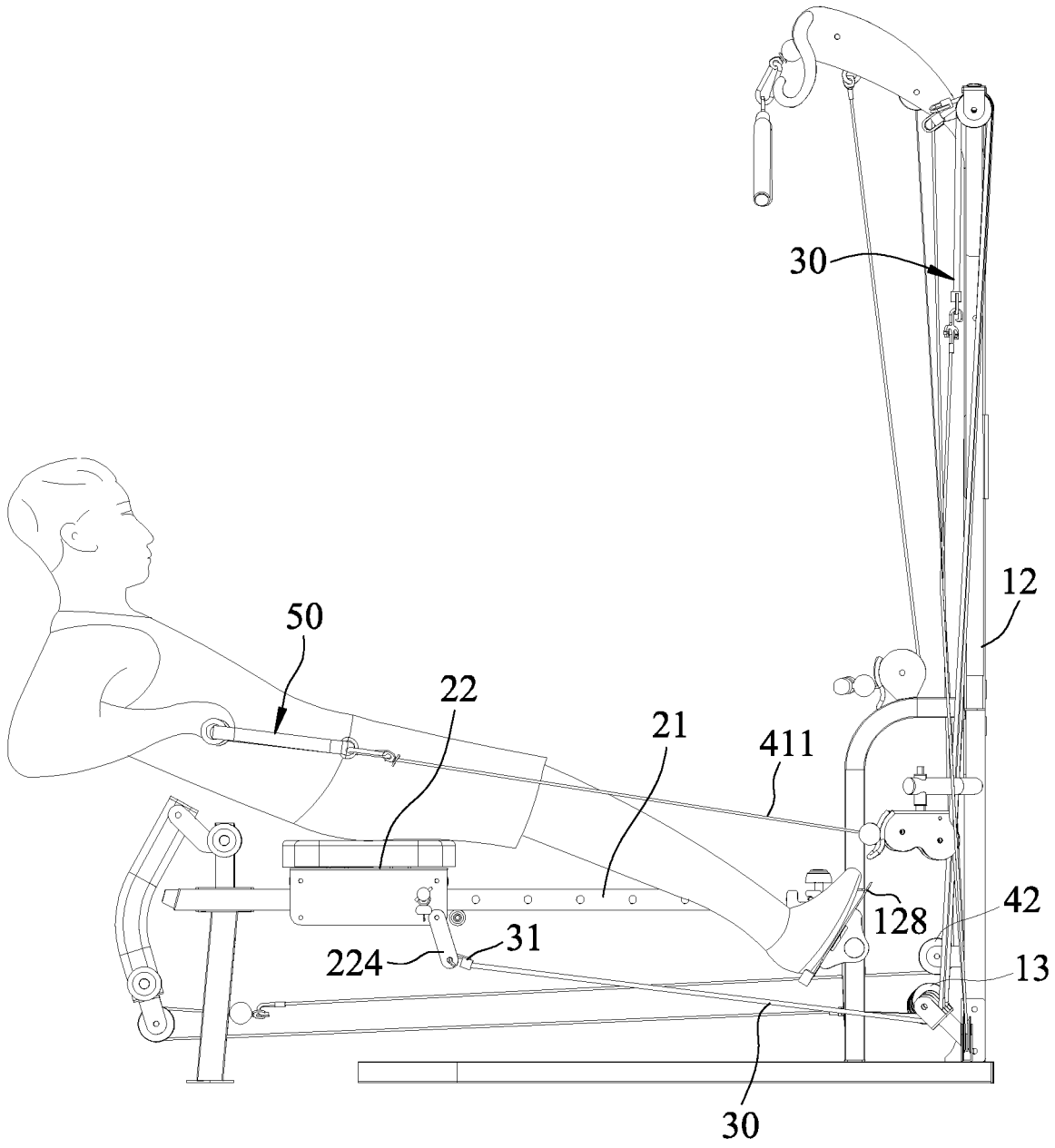
FIG. 3 is a side view of the embodiment, illustrating how a user can train his back muscle.

Referring to FIGS. 1 to 3, a fitness exercise apparatus according to an embodiment of the present disclosure is shown to comprise a main frame 10, a seat frame 20, a plurality of elastic cords 30, a plurality of pulling units 40, a pair of handles 50, and a pull rod 60.

The main frame 10 includes a base member 11, a support unit 12 and a plurality of guide wheels 13. The base member 11 is configured to be disposed on a support surface, such as a ground surface, and has an anti-skid plate 111 provided on a top surface thereof. The support unit 12 is disposed on the base member 11, and includes a middle support post 123 having a bottom portion 121 connected to the base member 11 and a top portion 122 opposite to the bottom portion 121, two side support posts 124 respectively connected to two opposite sides of the middle support post 123 between the top and bottom portions 122, 121 thereof, a hanging rod 125 connected to the middle support post 123 and located below the side support posts 124, two wheel frames 126 respectively disposed on two opposite ends of the hanging rod 125, a fixing frame 127 connected between the base member 11 and the middle support post 123, and a pair of foot pedals 128 mounted on the fixing frame 127.

The fixing frame 127 includes a substantially inverted U-shaped rod 1271, a vertical rod 1274, a curved rod 1275, and a horizontal rod 1276. The inverted U-shaped rod 1271 has two legs 1272 connected to the base member 11, and a bight portion 1273 connected between top ends of the vertical legs 1272. The vertical rod 1274 is connected to and extends upwardly from the bight portion 1273. The curved rod 1275 has two opposite ends respectively connected to a top end of the vertical rod 1273 and a central portion of the middle support post 123. The horizontal rod 1276 is connected between the vertical legs 1272 and is proximate to the base member 11. Some of the guide wheels 13 are disposed on the middle support post 123 in proximity to the bottom portion 121 thereof, while the other guide wheels 13 are disposed on top ends of the side support posts 124. The foot pedals 128 are respectively connected to outer sides of the vertical legs 1272.

The seat frame 20 is detachably connected to the main frame 10, and includes a guide rail 21 configured as a long rod having a first end portion 211 detachably connected to the fixing frame 127 and a second end portion 212 opposite to the first end portion 211 and distal to the fixing frame 127, a seat assembly 22 slidably disposed on the guide rail 21, a support post 26 having a bottom end configured to be disposed on the support surface and a top end opposite to the bottom end, a pair of knee support rods 23 respectively connected to two opposite sides of the top end of the support post 26, a swing rod 24 pivoted to the top end of the support post 26 and located between the knee support rods 23, and a pair of positioning rods 25 respectively connected to two opposite sides of the swing rod 24 and distal to the knee support rods 23. The second end portion 212 of the guide rail 21 is connected to the support post 26 between the top and bottom ends thereof. The seat assembly 22 is movable toward and away from the fixing frame 127 along the guide rail 21.

The seat frame 20 is movable between a use position (see FIGS. 1 and 2), in which it is connected to the fixing frame 127 and is located on top of the base member 11, and a storage position (see FIG. 9), in which it is detached from the fixing frame 127 and is mounted on the middle support post 123 at a side opposite to the fixing frame 127. Alternatively, the seat frame 20 may be pivotally connected to the fixing frame 127 so as to be movable between the use position, as shown in FIGS. 1 and 2, and a storage position (not shown), in which it is pivoted away from the base member 11 and is moved toward the middle support post 123. The seat assembly 22 includes a seat support 221, a seat cushion 222 mounted on top of the seat support 221, a plurality of rollers 223 attached to the seat support 221 and rollable along the guide rail 21, and a hanger 224 disposed on a bottom portion of the seat support 221.

The elastic cords 30 are mounted on the main frame 10 and are positioned on the side support posts 124. That is, each elastic cord 30 has a first cord end 31 extending out of one of the guide wheels 13 disposed on the middle support post 123 and hookable onto the horizontal rod 1276, and a second cord end 32 opposite to the first cord end 31 and extending out of one of the guide wheels 13 disposed on the top end of a corresponding one of the side support posts 124. The first cord ends 31 of two of the elastic cords 30 can be detached from the horizontal rod 1276 and then hooked onto the hanger 224 to dampen the sliding movement of the seat assembly 22.

Each of the pulling units 40 includes a plurality of pulley sets 41, 42 disposed on the main frame 10 and the seat frame 20, and a plurality of wires 411, 421. Two of the pulley sets 41 are respectively disposed on the wheel frames 126. Two pulleys of another pulley set 41 are respectively disposed on two opposite sides of the base member 11 in proximity to the middle support post 123. Two pulleys of one of the pulley sets 42 are respectively disposed on the swing rod 24 and the bottom portion of the middle support post 123. Another pulley set 42 has one pulley disposed on the curved rod 1275, and two pulleys disposed on the top portion of the middle support post 123.

Each of the wires 411 has one end extending out of the pulley set 41 disposed on one of the wheel frames 126, and the other opposite end looped around one of the pulleys of the another pulley set 41 disposed on the base member 11 and connected to the second cord end 32 of a corresponding one of the elastic cords 30 that extends out of a corresponding one of the guide wheels 13 disposed on the top ends of the side support posts 124.

One of the wires 421 has one end extending out of the pulley of the one of the pulley sets 42 that is disposed on the swing rod 24, and the other opposite end looped around the other pulley of the one of the pulley sets 42 that is disposed on the bottom portion of the middle support post 123 and then extending out of the pulley set 42 disposed on the top portion of the middle support post 123. Another one of the wires 421 has one end connected to the one end of the one of the wires 421 so that the two wires 421 are connected in series, and the other opposite end connected to a corresponding one of the elastic cords that extends out of one of the guide wheels 13 disposed on the middle support post 123.

Each of the handles 50 is detachably connected to the end of the wire 411 that extends out of the pulley set 41 disposed on the corresponding one of the wheel frames 126, as shown in FIG. 1. Alternatively, each handle 50 may be detachably connected to the second cord end 32 of one of the elastic cords 30 that extends out of one of the guide wheels 13 disposed on the top end of the corresponding one of the side support posts 124, as shown in FIG. 4.

The pull rod 60 is connected to the end of the wire 421 that extends out of the pulley set 42 disposed on the top portion of the middle support post 123.

With reference to FIGS. 1 and 2, when the seat frame 20 is in the use position, a user can select at least one of the elastic cords 30 and hook the first cord end 31 thereof onto the hanger 224 so as to connect the seat assembly 22 to the selected elastic cord 30, after which each handle 50 is connected to the end of the wire 411 that extends out of the corresponding wheel frame 126. Through this assembly, the user can perform different exercises according to his/her own requirement. With reference to FIG. 3, the user can perform a seated cable row exercise. In this exercise, after the user is seated on the seat assembly 22 with his two feet stepping on the foot pedals 128 and with his two hands gripping the handles 50, he can then apply a force to move the seat assembly 22 away from the support unit 12, and must resist the elastic force of the elastic cords 30 that are hooked on the hanger 224 to achieve the purpose of training. Simultaneously, the user's arms can pull the handles 50 so as to use the elastic force of the elastic cords 30 to generate damping motion, thereby effectively training the latissimus dorsi muscle and the trapezius muscle.

Figure 4:
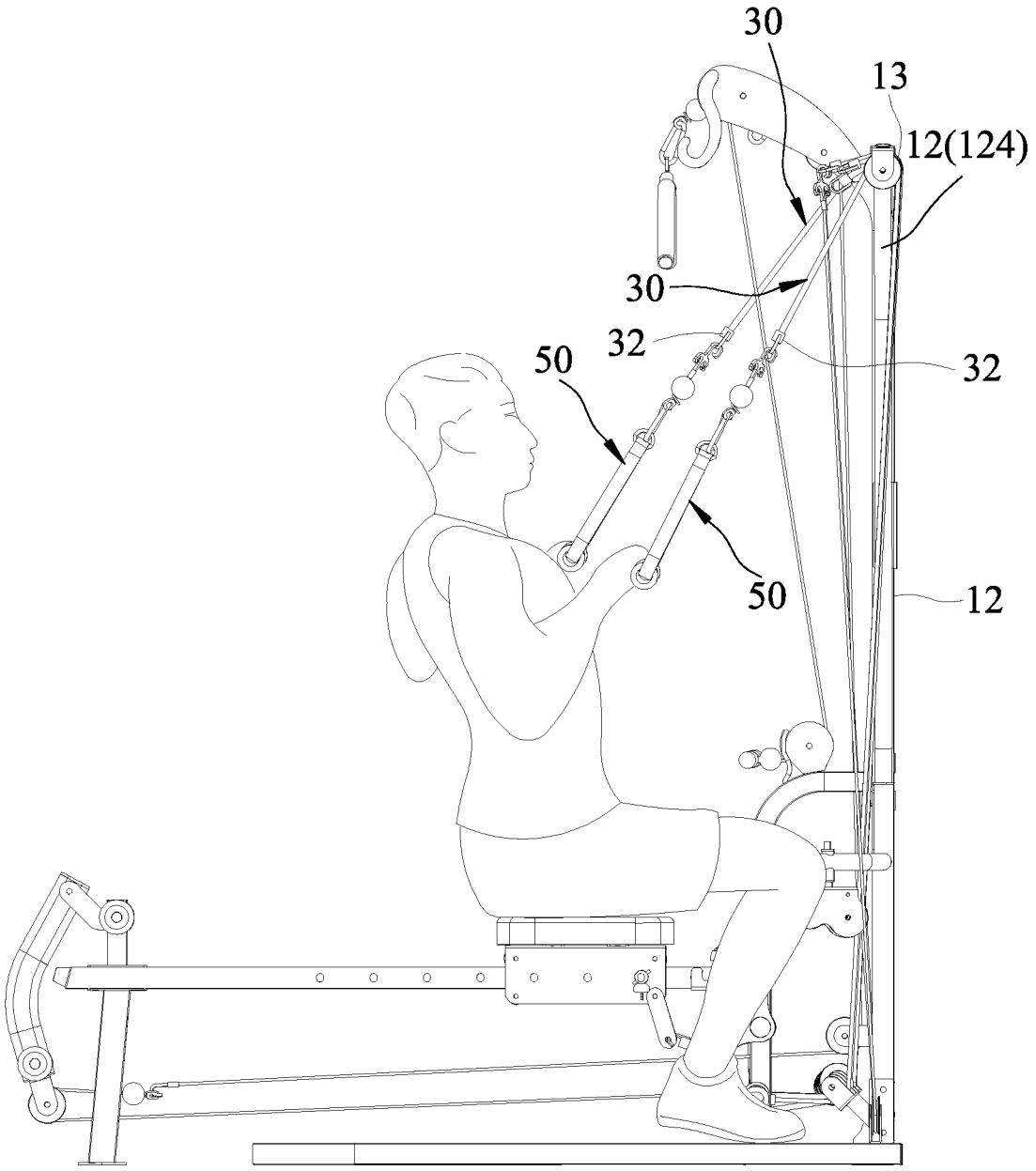
FIG. 4 is a view similar to FIG. 3, but illustrating how the user can expand his chest.

Referring to FIG. 4, each handle 50 is connected to the second cord end 32 of one of the elastic cords 30 that extends out of one of the guide wheels 13 disposed on the top end of the corresponding side support post 124. After the user is seated on the seat assembly 22 and faces the support unit 12, his two hands grip the handles 50 and then pull the same so as to use the elastic force of the elastic cords 30 to generate the damping motion and achieve a chest pull exercise or a seated straight arm pulldown exercise.

Figure 5:
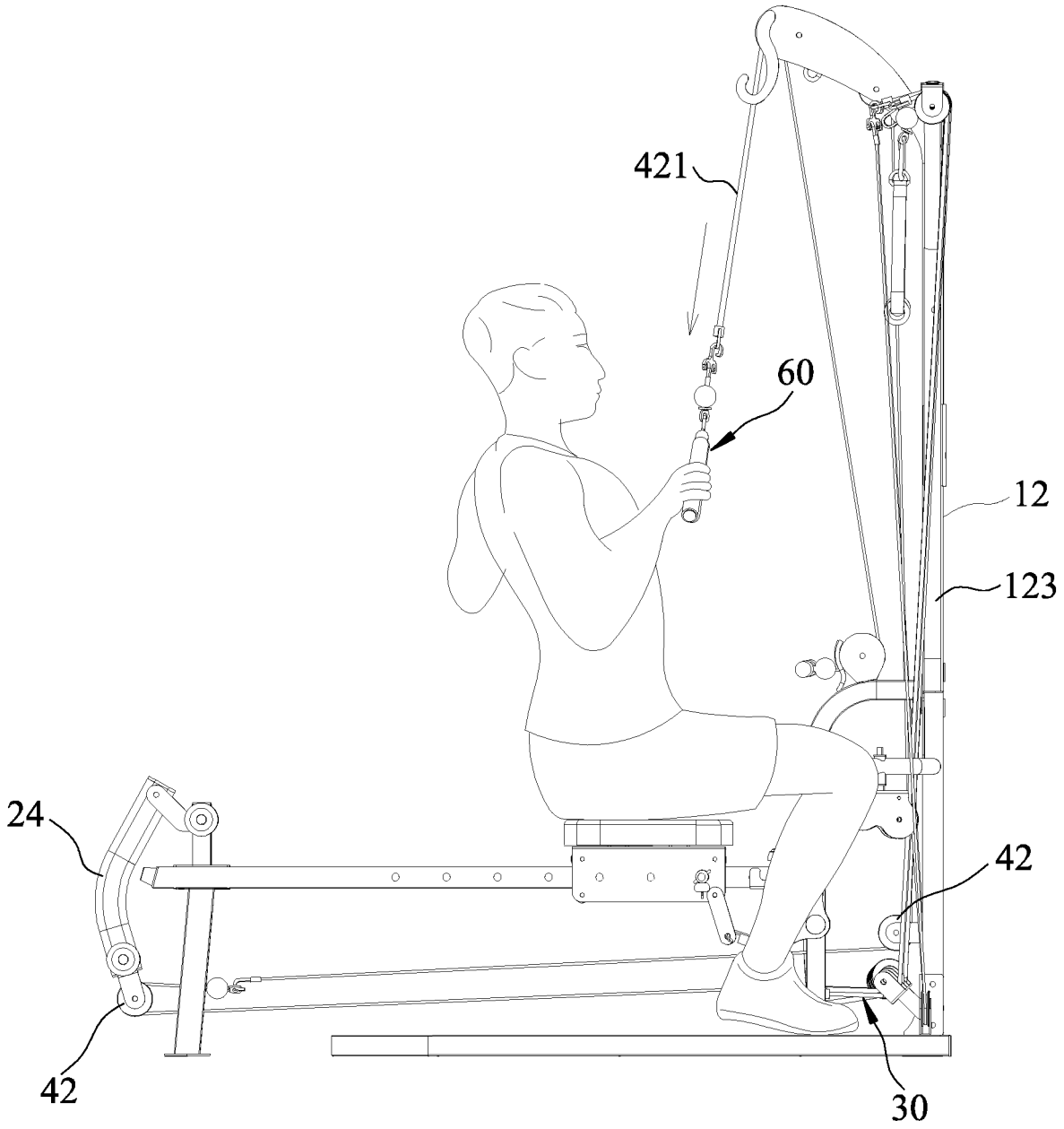
FIG. 5 is a view similar to FIG. 3, but illustrating the user performing a wide grip lat pulldown exercise.
Figure 6:
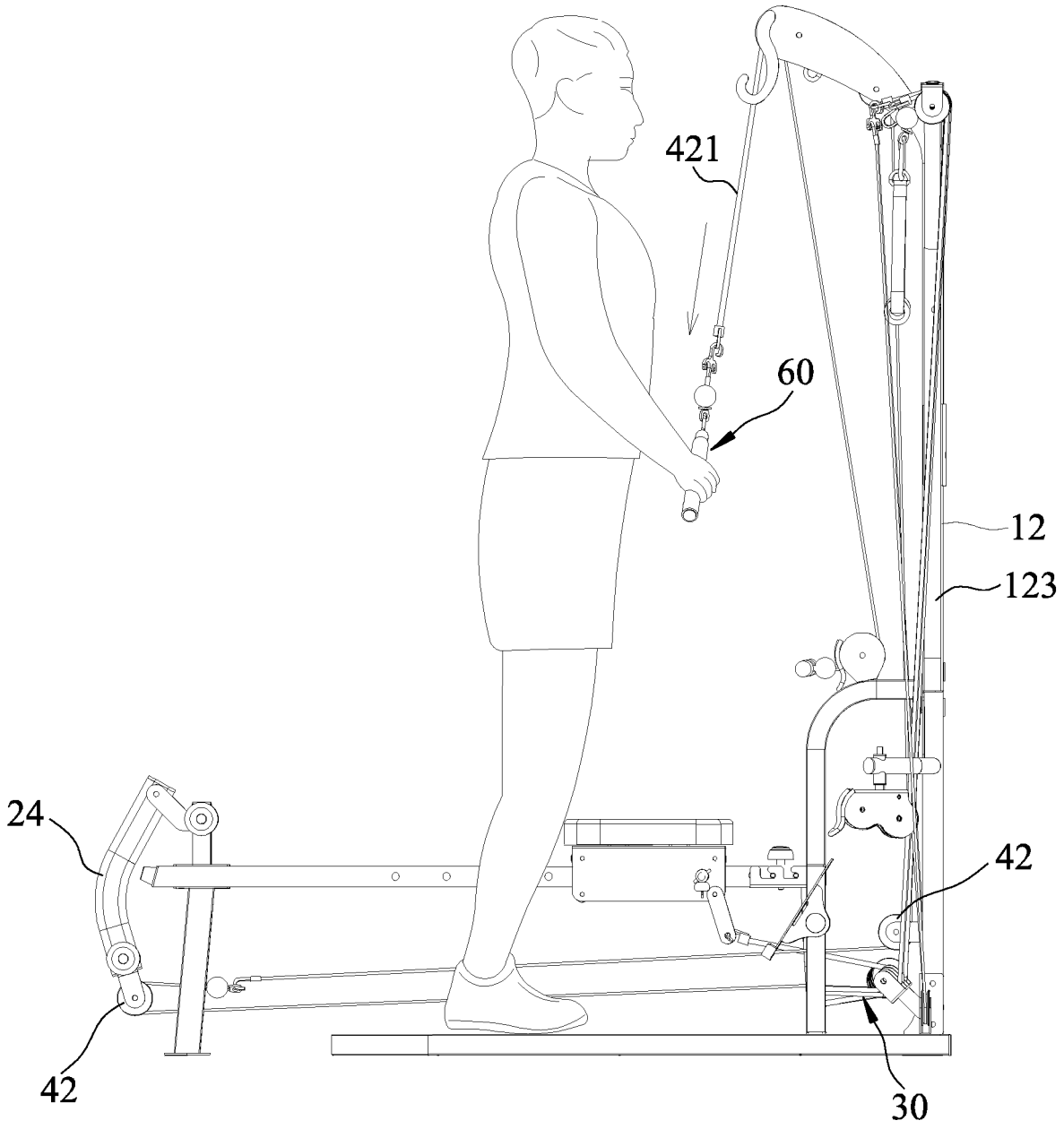
FIG. 6 is a view similar to FIG. 3, but illustrating the user performing a triceps push down exercise.

Referring to FIG. 5, the user sits on the seat assembly 22 facing the support unit 12 and pulls down the pull rod 60. By using the pull rod 60 which is connected to the end of the wire 421 that extends out of the pulley set 42 disposed on the top portion of the middle support post 123, and with one of the wires 421 being connected to one of the elastic cords 30, a wide grip lat pulldown exercise can be performed. If the user sits facing away from the support unit 12, a wide grip rear pulldown exercise (not shown) can be performed. If the user stands up and pull the pull rod 60, as shown in FIG. 6, a triceps push down exercise can be performed.

Figure 7:
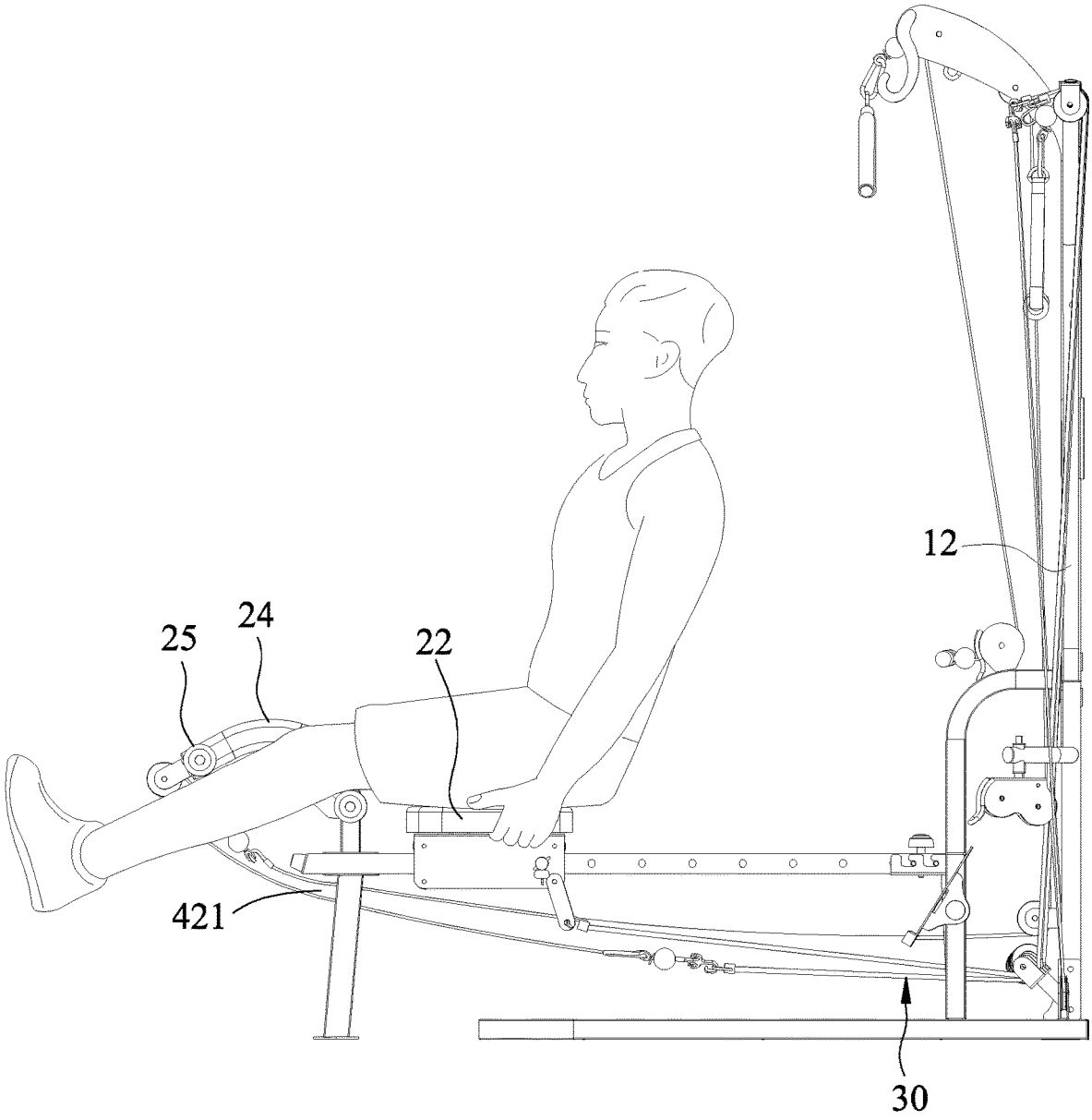
FIG. 7 is a view similar to FIG. 3, but illustrating the user performing a leg extension exercise.

Referring to FIG. 7, the user sits on the seat assembly 22 facing away from the support unit 12 with his hands gripping two sides of the seat assembly 22 and with his feet hooked onto the positioning rods 25. When the user uses his feet to apply a force on the swing rod 24 to move the same upwardly, the wires 421 connected in series and the connected elastic cord 30 can be pulled so that a leg extension exercise can be performed.

Figure 8:
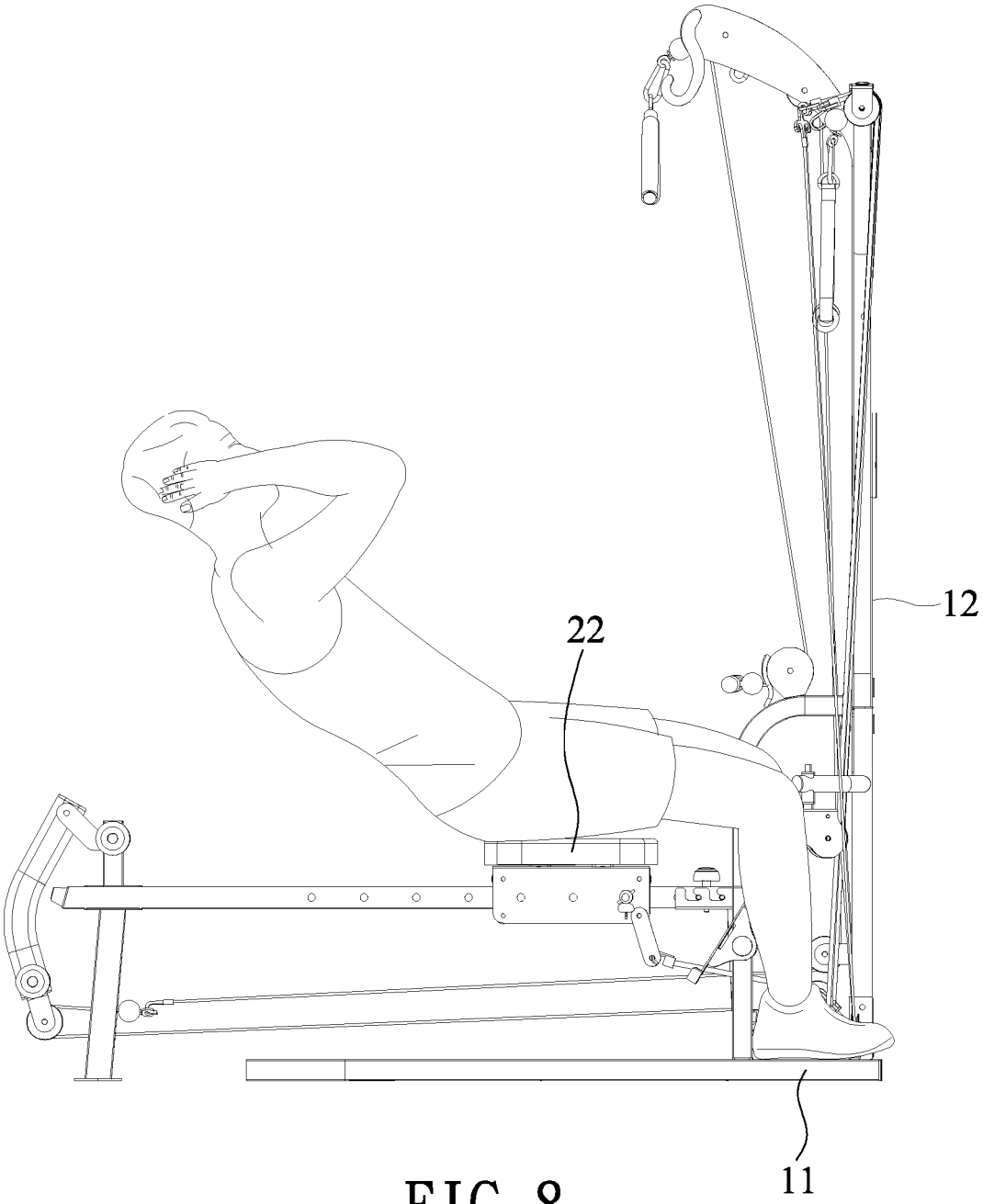
FIG. 8 is a view similar to FIG. 3, but illustrating the user performing an abdominal crunch exercise.

Referring to FIG. 8, the user sits on the seat assembly 22 facing the support unit 12 with his two feet stepping on the base member 11, an abdominal crunch exercise can be performed.

Figure 9:
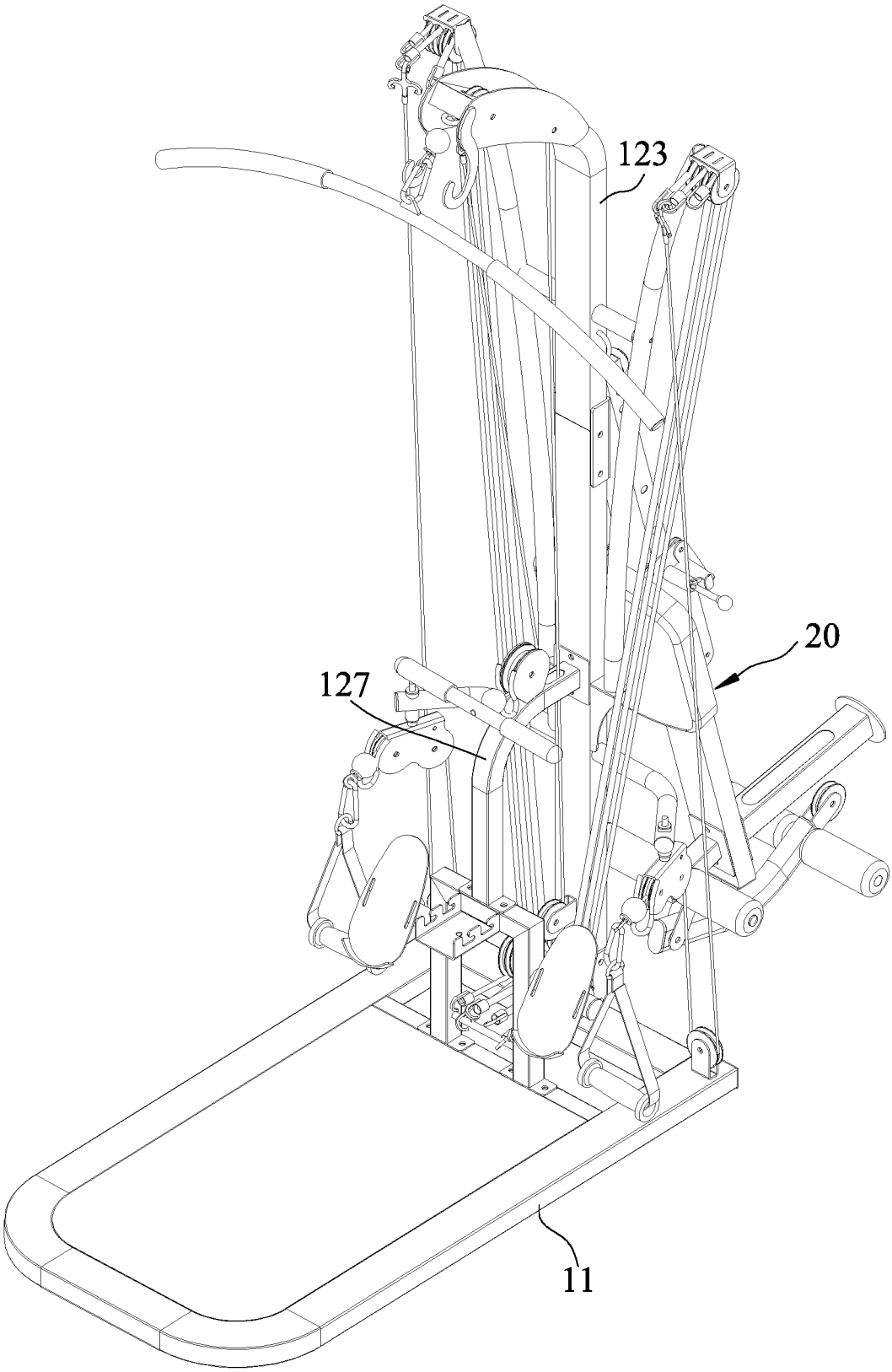
FIG. 9 is a view similar to FIG. 1, but with a seat frame being detached from a fixing frame and being mounted on a middle support post at a side opposite to the fixing frame.

Referring to FIG. 9, the seat frame 20 is detached from the fixing frame 127, and is disposed in the storage position, in which it is mounted on the middle support post 123 at the side opposite to the fixing frame 127.

Figure 10:
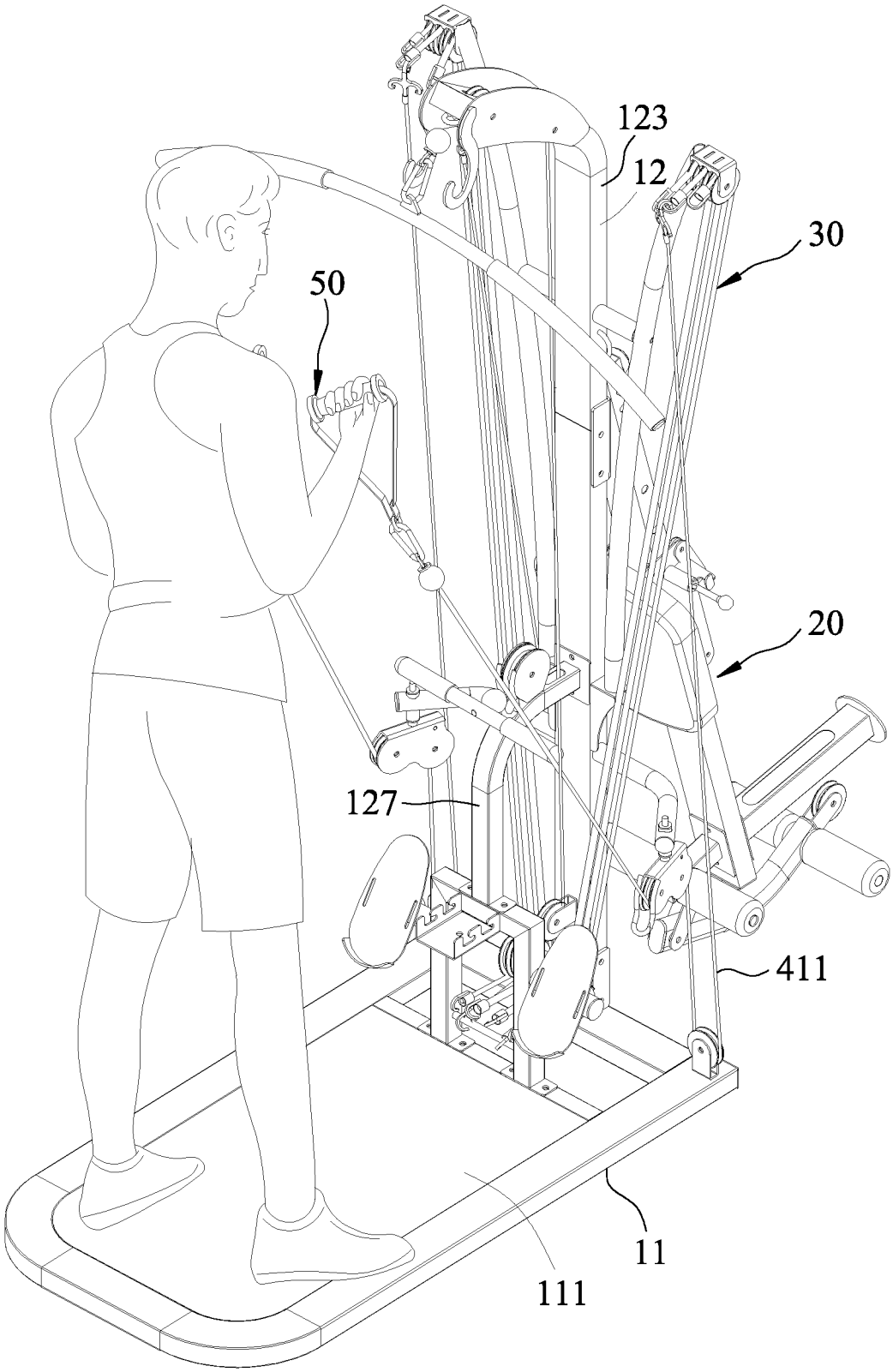
FIG. 10 is a view similar to FIG. 9, but illustrating how the user can perform a standing biceps curl low pulley exercise.

Referring to FIG. 10, with the seat frame 20 in the storage position, the user can now stand on the anti-skid plate 111 of the base member 11. With his two hands gripping the handles 50, the user's arms can then pull the handles 50 to perform a standing biceps curl low pulley exercise. The user may use one hand to grip one handle 50 so as to perform a one arm biceps curl low pulley exercise; may use two hands to grip one handle 50 to perform a standing close grip biceps curl exercise; or, may use one hand to grip one handle 50 and with his body slanting relative to the fitness exercise apparatus to perform a cross body biceps curl exercise. The user may stand facing away from the support unit 12 to perform a reverse standing biceps curl exercise, or may stand facing the support unit 12 to perform a standing low pulley cable fly exercise. The above exercises differ only in training the different parts of the user's body, so they are not shown in the figures.

Figure 11:
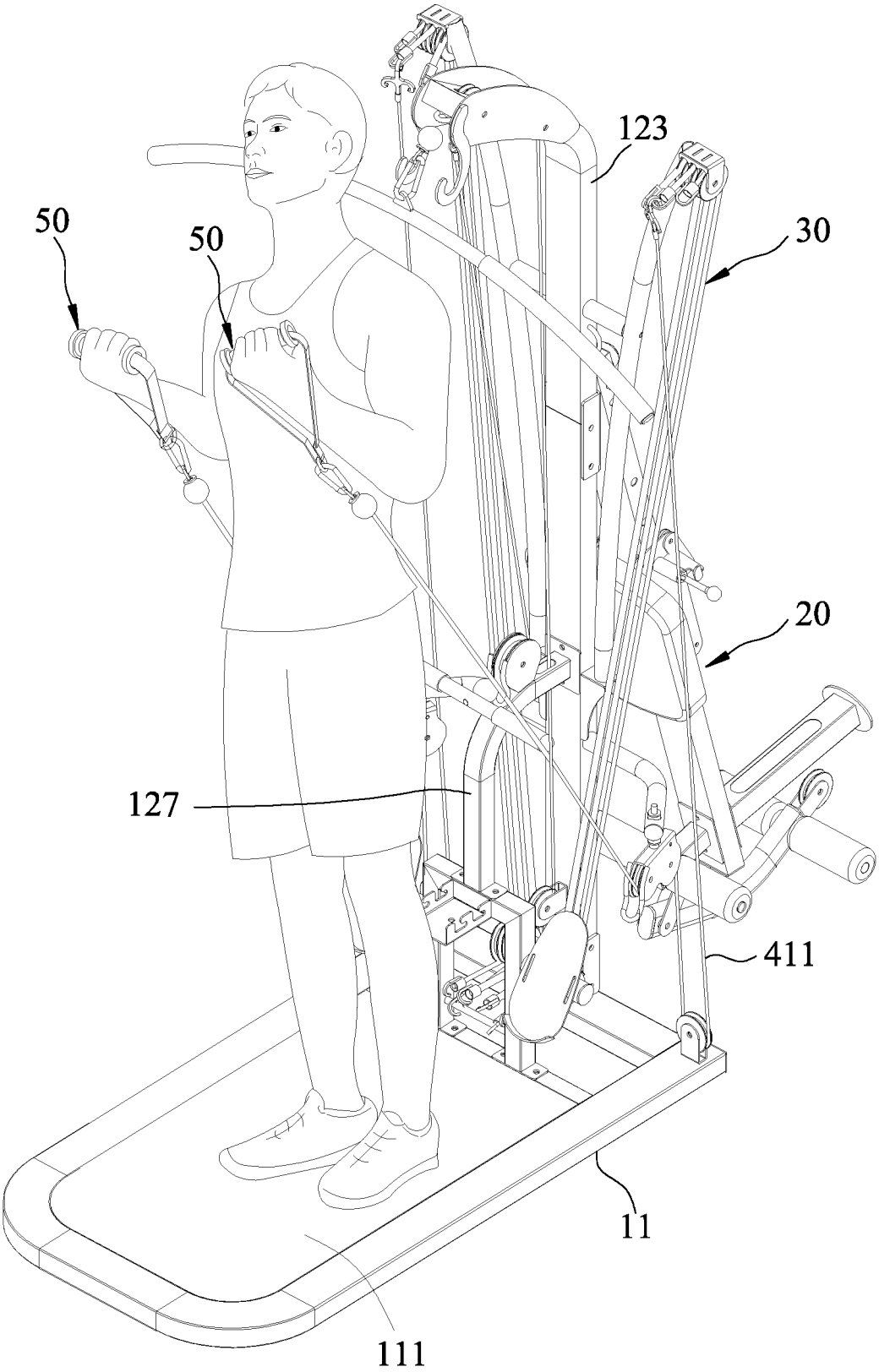
FIG. 11 is a view similar to FIG. 9, but illustrating how the user can perform an alternating straight arm pulldown exercise.

Referring to FIG. 11, with the user standing on the anti-skid plate 111 of the base member 11 facing away from the support unit 12 and with his hands gripping the handles 50, the user's arms can then pull the handles 50 upward to perform a reverse standing biceps curl low pulley exercise.

Figure 12:
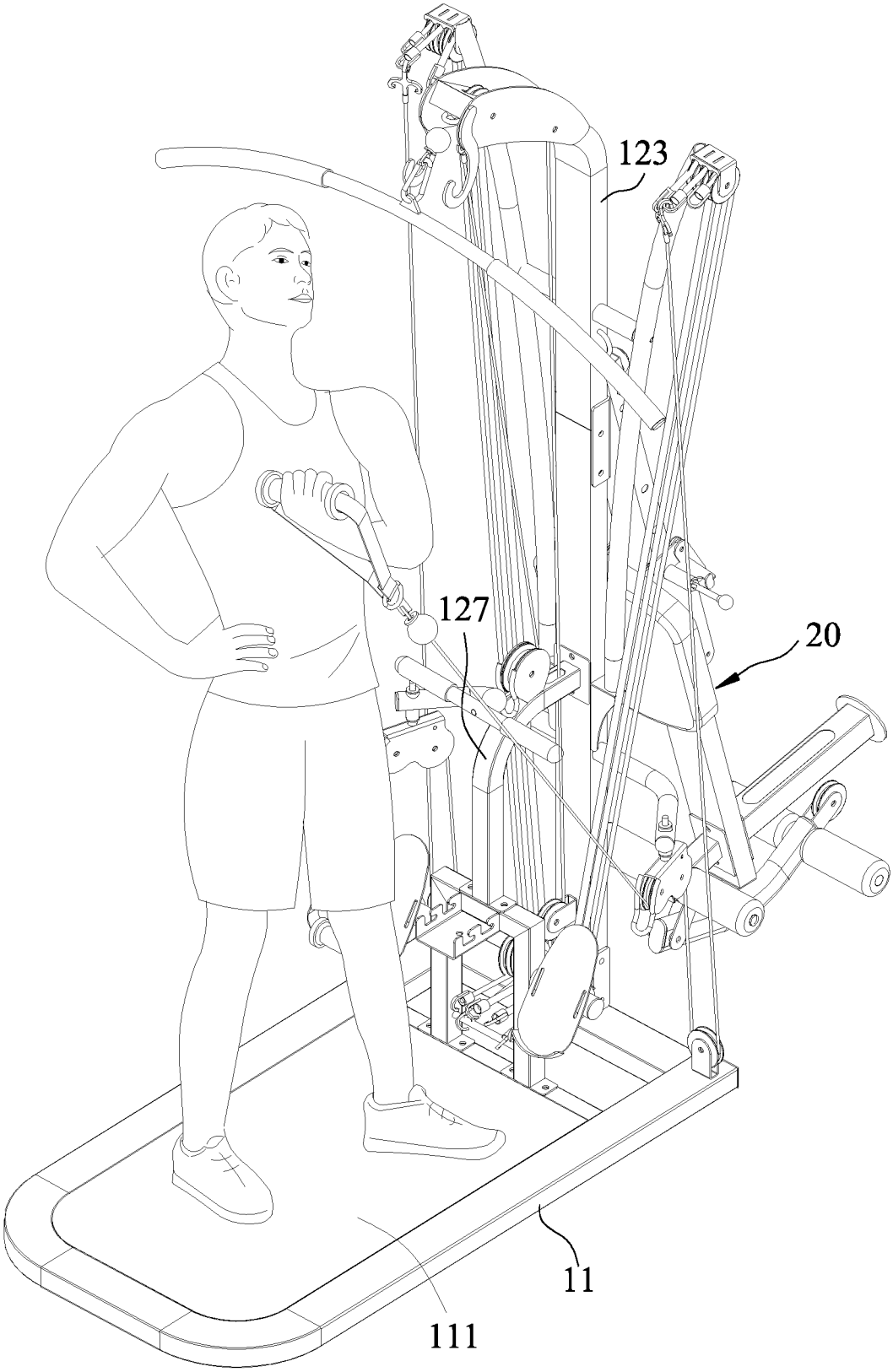
FIG. 12 is a view similar to FIG. 9, but illustrating how the user can perform a reverse standing biceps curl low pulley exercise.

Referring to FIG. 12, with the user standing on the anti-skid plate 111 of the base member 11 in a slant manner relative to the base member 11 and with his one hand gripping one handle 50, the user's arm can then pull the handle 50 upward to perform a cross body biceps curl exercise.

Figure 13:
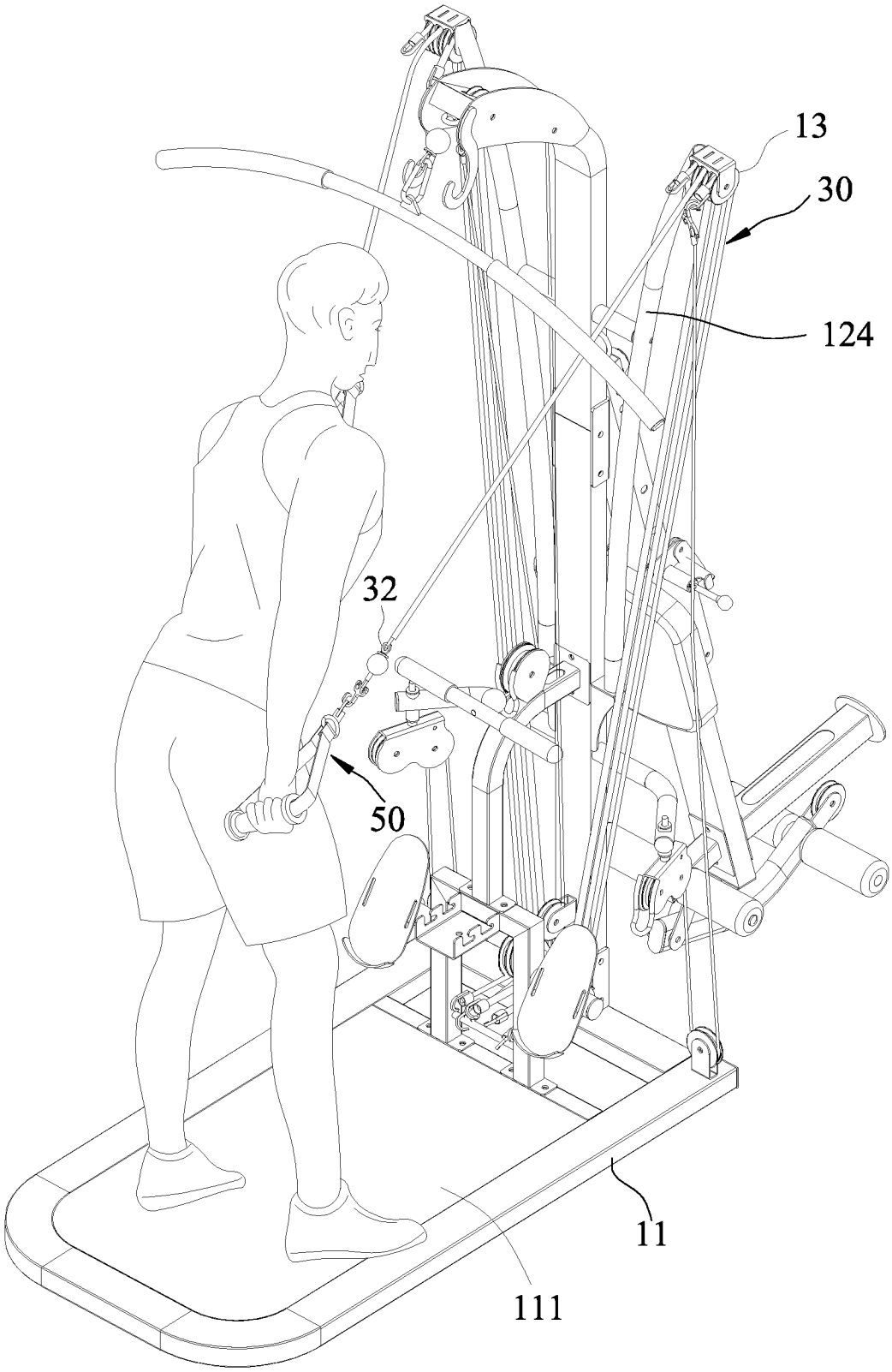
FIG. 13 is a view similar to FIG. 9, but illustrating the user performing a cross body biceps curl exercise.

Referring to FIG. 13, each handle 50 is connected to the second cord end 32 of one of the elastic cords 30 that extends out of one of the guide wheels 13 disposed on the top end of the corresponding side support post 124. With the user standing on the anti-skid plate 111 of the base member 11 and with his two hands gripping the handles 50, the user's arms can then pull the handles 50 downward to perform an alternating straight arm pulldown exercise, or a standing straight arm pulldown exercise (not shown).

It is worth to mention herein that, in actual practice, different thicknesses and different numbers of the elastic cords 30 may be selected to obtain different damping effects, and to meet the different demands of training, the damping curve of the elastic cord 30 (F=KX, external force is proportional to elongation) is similar to the human muscle strength. The damping can be changed from 10 to 100 kgs. regardless of the user's sex and age. Further, by using the combination of the wire 411 and the elastic cord 30, the range of different kinds of users is wide. The stroke of the wire 411 is long, so that the user having a height of 1.4 to 1.9 meters can use the fitness exercise apparatus of this disclosure.

The efficiency of this disclosure resides in that, by using the elastic cords 30 to provide damping motion and through the overall coordination, the purpose of training the muscles of the different parts of the user's body can be achieved. Further, by using the elastic cords 30 made of rubber, they can quickly return when stretched to different lengths. This feature adds a lot of usability and functionality to aerobic training. Moreover, the fitness exercise apparatus of this disclosure has a simple overall structure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A fitness exercise apparatus comprising:

a main frame including a base member, and a support unit disposed on said base member, said support unit having a bottom portion connected to said base member, and a top portion opposite to said bottom portion;

a seat frame connected to said main frame and including a guide rail, and a seat assembly slidably disposed on said guide rail, said seat assembly being movable toward and away from said support unit along said guide rail;

a plurality of elastic cords mounted on said main frame, each of said elastic cords extending from said bottom portion to said top portion of said support unit, at least one of said elastic cords dampening the sliding movement of said seat assembly;

a plurality of pulling units, each of said pulling units including a plurality of pulley sets provided on said main frame and said seat frame, and a plurality of wires each of which is looped around a corresponding one of said pulley sets and connectable with a corresponding one of said elastic cords; and a pair of handles each of which is connected to a selected one of said elastic cord and said wire;

wherein said support unit includes a middle support post, two side support posts respectively connected to two opposite sides of said middle support post, and a fixing frame connected between said base member and said middle support post, said fixing frame including a substantially inverted U-shaped rod, a vertical rod, a curved rod, and a horizontal rod, said inverted U-shaped rod having two legs connected to said base member, and a bight portion connected between top ends of said vertical legs, said vertical rod being connected to and extending upwardly from said bight portion, said curved rod having two opposite ends respectively connected to a top end of said vertical rod and a central portion of said middle support post, said horizontal rod being connected between said vertical legs and being proximate to said base member;

wherein said elastic cords are respectively positioned on said side support posts; and wherein said seat frame is detachably connected to said fixing frame, and is movable between a use position, in which said seat frame is connected to said fixing frame and is located on top of said base member, and a storage position, in which said seat frame is detached from said fixing frame and is mounted on said middle support post at a side opposite to said fixing frame.

2. The fitness exercise apparatus as claimed in claim 1, wherein said middle support post has said top and bottom portions of said support unit, said support unit further including a hanging rod connected to said middle support post between said top and bottom portions thereof, and two wheel frames respectively disposed on two opposite ends of said hanging rod, at least two of said pulley sets being respectively disposed on said wheel frames.

3. The fitness exercise apparatus as claimed in claim 1, wherein said guide rail has a first end portion detachably connected to said fixing frame, and a second end portion opposite to said first end portion and distal to said fixing frame, said seat frame further including a support post connected to said second end portion of said guide rail, a pair of knee support rods respectively connected to two opposite sides of said support post at a top end thereof, a swing rod pivoted to said top end of said support post and located between said knee support rods, and a pair of positioning rods respectively connected to two opposite sides of said swing rod and distal to said knee support rods.

4. The fitness exercise apparatus as claimed in claim 3, further comprising a pull rod connected to one of said wires, said one of said wires looping around said pulley set that is disposed on said middle support post and said swing rod.

5. The fitness exercise apparatus as claimed in claim 1, wherein said support unit further includes a pair of foot pedals mounted on said fixing frame.

* * * * *